US009945269B2

(12) United States Patent
Ahmed et al.

(10) Patent No.: US 9,945,269 B2
(45) Date of Patent: Apr. 17, 2018

(54) SWITCHABLE VALVE TRAIN ROCKER SHAFT

(71) Applicant: Schaeffler Technologies AG & Co. KG, Herzogenaurach (DE)

(72) Inventors: Faheem Ahmed, Troy, MI (US); Colin Foster, Belle River (CA); David Chandler, Windsor (CA); John Whitton, Milwaukee, WI (US); Debora Manther, Royal Oak, MI (US); Pradeep Mohan Mohan Das, Troy, MI (US); Sumukha Nagaraj, Dearborn, MI (US)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 130 days.

(21) Appl. No.: 15/175,654

(22) Filed: Jun. 7, 2016

(65) Prior Publication Data

US 2017/0350280 A1 Dec. 7, 2017

(51) Int. Cl.
*F01L 1/14* (2006.01)
*F01L 1/18* (2006.01)

(52) U.S. Cl.
CPC ..... *F01L 1/181* (2013.01)

(58) Field of Classification Search
CPC ..... F01L 1/181
USPC ..... 123/90.39
See application file for complete search history.

(56) References Cited

U.S. PATENT DOCUMENTS

| | | | | |
|---|---|---|---|---|
| 5,125,373 | A | 6/1992 | Yamada et al. | |
| 6,347,606 | B1 * | 2/2002 | Tanaka | F01L 1/053 123/90.16 |
| 6,598,578 | B2 | 7/2003 | Takahashi et al. | |
| 6,810,846 | B2 | 11/2004 | Murata et al. | |
| 2008/0302322 | A1 | 12/2008 | Edelmayer et al. | |

OTHER PUBLICATIONS

U.S. Appl. No. 62/195,835, filed Jul. 23, 2015. (Unpublished).

* cited by examiner

*Primary Examiner* — Zelalem Eshete
(74) *Attorney, Agent, or Firm* — Volpe and Koenig, P.C.

(57) ABSTRACT

A switchable valve train assembly including a rocker shaft is provided. The rocker shaft includes a first chamber extending between a first axial end and a second axial end of the rocker shaft and a second chamber extending between the first axial end and the second axial end of the rocker shaft. A seepage orifice is defined between the first chamber and the second chamber and provides a fluid connection between the first chamber and the second chamber. The first chamber includes a first actuator port in fluid connection with a first intake port for a hydraulic lash adjuster. The second chamber includes a second actuator port in fluid connection with a second intake port for a locking assembly.

17 Claims, 3 Drawing Sheets

SWITCHABLE VALVE TRAIN ROCKER SHAFT

FIELD OF INVENTION

The present invention relates to a switchable valve train, and more particularly relates to a rocker shaft for a switchable valve train.

BACKGROUND

Multiple types of switchable valve train systems including rocker arms arranged on rocker shafts are known. One type of switchable valve train system includes rocker arms with a hydraulic lash adjuster and a locking assembly arranged on opposite sides of the rocker arm. One type of known rocker shaft includes a hollow center for directing hydraulic fluid from a feed port to the hydraulic lash adjuster and the locking assembly of an associated rocker arm.

One known arrangement of a switchable valve train is shown in FIG. 1, which is from U.S. Pub. 2008/0302322. As shown in FIG. 1, the switchable valve train assembly 100 includes a rocker shaft 101 having a plurality of intake ports 102. A plurality of rocker arm assemblies 110 are provided along the rocker shaft 101 that include a camshaft end 106 and a valve end 108. The rocker shaft 101 includes a hollow center 104 for directing hydraulic fluid from a hydraulic fluid supply assembly (not shown) to the associated rocker arm assemblies 110. The rocker arm assemblies 110 are configured to selectively control actuation of a locking assembly and to supply pressurized hydraulic fluid to the lash adjuster (not shown) associated with each rocker arm assembly 110 based on a supply of hydraulic fluid from the hollow center 104 of the rocker shaft 101. The flow of hydraulic fluid through the rocker shaft 101 can create air bubbles or pockets, which causes hydraulic fluid flow fluctuations and disrupts performance of the rocker arm assemblies.

It would be desirable to provide a rocker shaft that offers a reliable, continuous flow of de-aerated hydraulic fluid from the hydraulic fluid supply assembly to the locking assembly and lash adjuster of the rocker arm assembly.

SUMMARY

A switchable valve train assembly including a rocker shaft with an improved internal chamber configuration that reduces air pockets and air bubbles is provided. The switchable valve train assembly includes a supply assembly having a fluid source for pressurized hydraulic fluid, and a solenoid and a control valve for selectively supplying the hydraulic fluid. A first journal includes a hydraulic lash adjuster feed channel in fluid connection with the fluid source. A second journal includes a switch channel in fluid connection with the fluid source. The rocker shaft includes a first chamber extending between a first axial end and a second axial end of the rocker shaft, and a second chamber, adjacent to the first chamber, extending between the first axial end and the second axial end of the rocker shaft. A first end cap is fixed on the first axial end of the rocker shaft and a second end cap is fixed on the second axial end of the rocker shaft. The first end cap and the second end cap each define axial ends of the first chamber and the second chamber. A seepage orifice is defined between the first chamber and the second chamber and provides a fluid connection between the first chamber and the second chamber. A feed port in the rocker shaft connects the hydraulic lash adjuster feed channel of the first journal to the first chamber. A switch port in the rocker shaft connects the switch channel of the second journal to the second chamber. A rocker arm assembly is arranged on the rocker shaft and includes a hydraulic lash adjuster and a locking assembly. The first chamber includes a first actuator port in fluid connection with a first intake port for the hydraulic lash adjuster, and the second chamber includes a second actuator port in fluid connection with a second intake port for the locking assembly.

The seepage orifice provides a limited fluid connection between the first chamber and the second chamber and ensures a continuous flow of hydraulic fluid which helps reduce air pockets and air bubbles in the hydraulic fluid.

BRIEF DESCRIPTION OF THE DRAWINGS

The foregoing Summary and the following detailed description will be better understood when read in conjunction with the appended drawings, which illustrate a preferred embodiment of the invention. In the drawings.

DETAILED DESCRIPTION OF THE PREFERRED EMBODIMENTS

Figure 1:
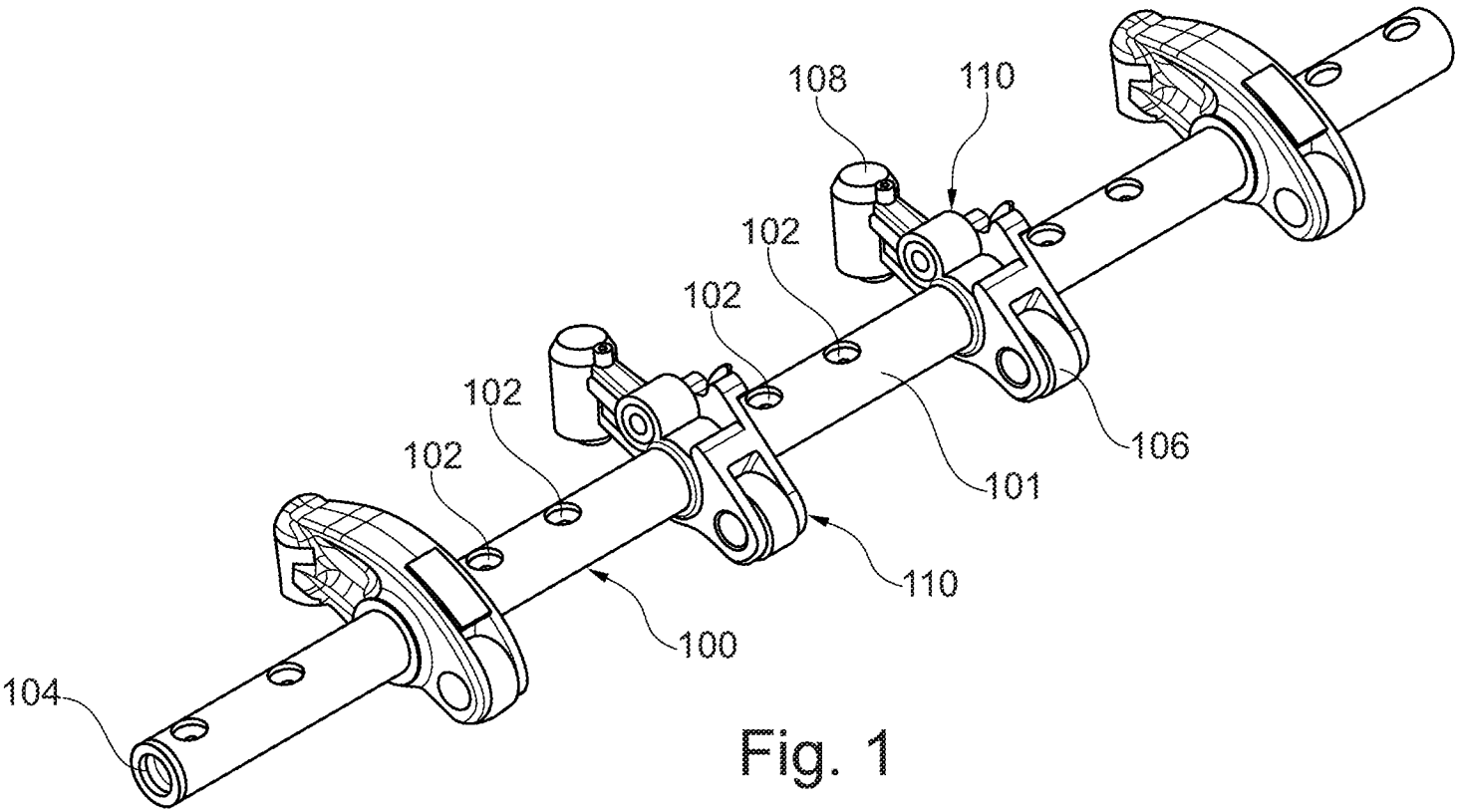
Fig. 1 ( PRIOR ART )
FIG. 1 is a perspective view of a rocker shaft according to the prior art.

Certain terminology is used in the following description for convenience only and is not limiting. The words "front," "rear," "upper" and "lower" designate directions in the drawings to which reference is made. The words "inwardly" and "outwardly" refer to directions toward and away from the parts referenced in the drawings. "Axially" refers to a direction along the axis of a shaft. A reference to a list of items that are cited as "at least one of a, b, or c" (where a, b, and c represent the items being listed) means any single one of the items a, b, or c, or combinations thereof. The terminology includes the words specifically noted above, derivatives thereof and words of similar import.

Figure 2:
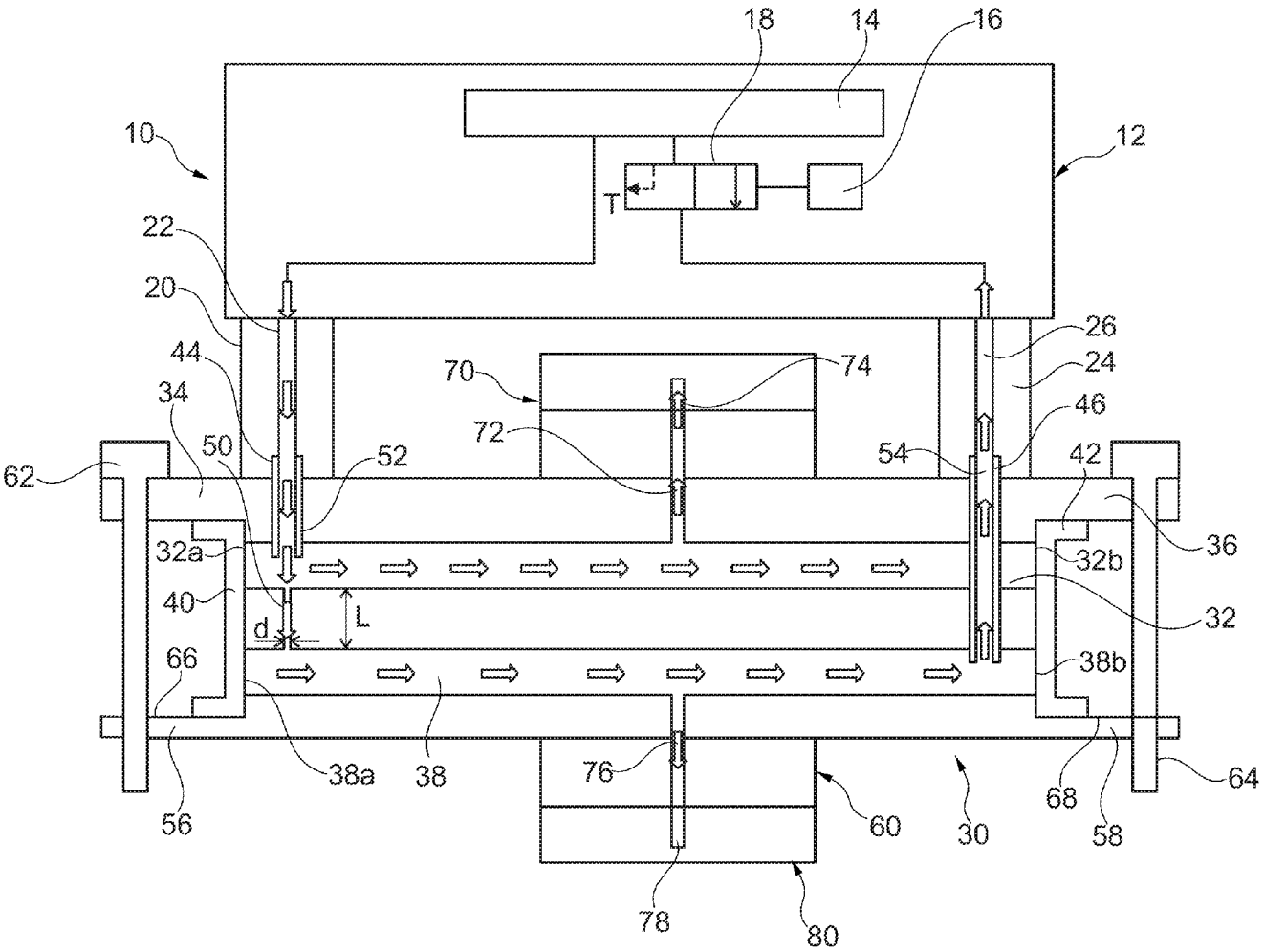
FIG. 2 is a schematic sectional view of a switchable valve train assembly according to an embodiment of the disclosure in a non-actuated state.
Figure 3:
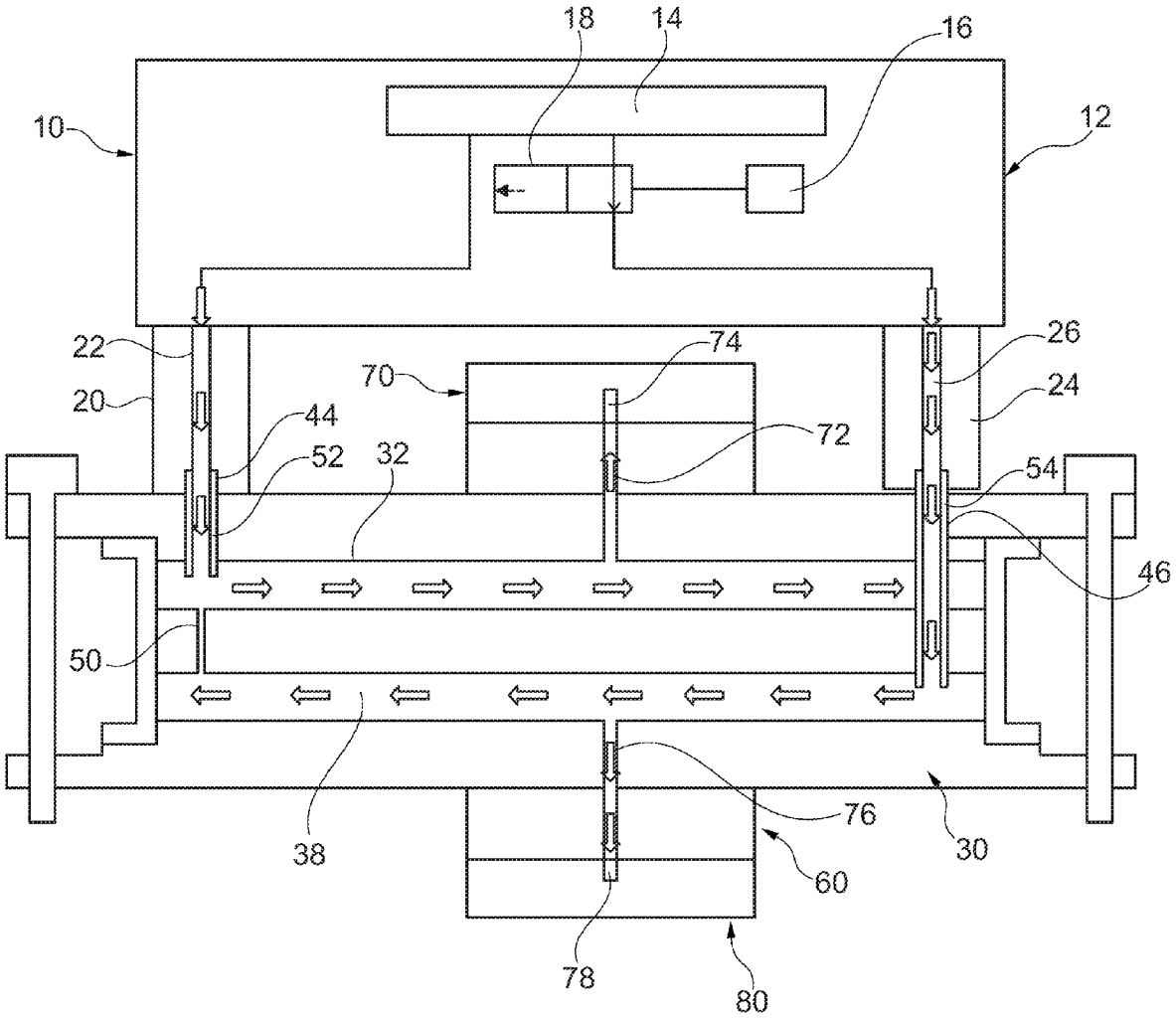
FIG. 3 is a schematic sectional view of the switchable valve train assembly of FIG. 2 in an actuated state.

Referring to FIGS. 2 and 3, a switchable valve train assembly 10 including a supply assembly 12 and a rocker shaft 30 is provided. The supply assembly 12 includes a fluid source 14 for pressurized hydraulic fluid, and a solenoid 16 and a control valve 18 for selectively supplying the hydraulic fluid. A first journal 20 includes a hydraulic lash adjuster feed channel 22 in fluid connection with the fluid source 14, and a second journal 24 includes a switch channel 26 in fluid connection with the fluid source 14.

The rocker shaft 30 defines a first chamber 32 extending between a first axial end 34 and a second axial end 36 of the rocker shaft 30 and a second chamber 38 extending between the first axial end 34 and the second axial end 36 of the rocker shaft 30. As shown in FIGS. 2 and 3, the first chamber 32 and second chamber 38 are arranged adjacent to each other. FIGS. 2 and 3 illustrate a shortened representation of a typical rocker shaft 30 with a single rocker arm 60. One of ordinary skill in the art recognizes that a longer rocker shaft 30 can be used with multiple rock arms, such as shown in FIG. 1, while maintaining the general configuration of the rocker shaft 30 described herein and illustrated in FIGS. 2 and 3. The rocker shaft 30 can be formed from steel, aluminum, or any other suitable material.

A feed port 52 in the rocker shaft 30 connects the hydraulic lash adjuster feed channel 22 of the first journal 20 to the first chamber 32. A switch port 54 in the rocker shaft 30 connects the switch channel 26 of the second journal 24 to the second chamber 38. A first sleeve 44 preferably extends between the hydraulic lash adjuster feed channel 22 of the first journal 20 and the first chamber 32. A second sleeve 46 preferably extends between the switch channel 26 of the second journal 24 and the second chamber 38. One of ordinary skill in the art would recognize from the present disclosure that alternative channeling arrangements could be used to direct hydraulic fluid from the supply assembly 12 to the rocker shaft 30 which do not include separately formed sleeves 44, 46.

The rocker shaft 30 preferably includes a first axially extending flange 56 at the first axial end 34 and a second axially extending flange 58 at the second axial end 36. A first bolt 62 preferably radially extends through the first axially extending flange 56 and a second bolt 64 preferably radially extends through the second axially extending flange 58. A first end cap 40 is fixed on the first axial end 34 of the rocker shaft 30 and a second end cap 42 is fixed on the second axial end 36 of the rocker shaft 30. The first end cap 40 and the second end cap 42 each define axial ends 32*a*, 32*b* of the first chamber 32 and axial ends 38*a*, 38*b* of the second chamber 38. The first end cap 40 is preferably fixed to the first axial end 34 of the rocker shaft 30 via a press-fit against a radially inner surface 66 of the first axially extending flange 56. The second end cap 42 is also preferably fixed to the second axial end 36 of the rocker shaft 30 via a press-fit against a radially inner surface 68 of the second axially extending flange 58. One of ordinary skill in the art would recognize from the present disclosure that alternative configurations of the end portions of the rocker shaft 30 may be used.

A seepage orifice 50 is defined between the first chamber 32 and the second chamber 38 and provides a limited fluid connection between the first chamber 32 and the second chamber 38. The seepage orifice 50 preferably has a internal diameter (d) between 0.1 mm to 1.0 mm, with a corresponding length (L) that is preferably five to ten times larger than the internal diameter (d) to generate a restricted hydraulic fluid pressure. Based on these dimensions, the restricted hydraulic fluid pressure is preferably between 0.1 bar to 0.4 bar. The seepage orifice 50 acts as a throttle and provides a restricted, but continuous flow of hydraulic fluid between the first chamber 32 and the second chamber 38 which reduces air pockets and air bubbles in the second chamber 38 in order to improve the function of the switchable valve train assembly 10. The seepage orifice 50 ensures that the second chamber 38 is always primed with hydraulic fluid and immediately available for a switching operation which reduces switching times of the switchable valve train assembly 10.

A rocker arm assembly 60 is arranged on the rocker shaft 30 and includes a hydraulic lash adjuster 70 and a locking assembly 80. The first chamber 32 includes a first actuator port 72 in fluid connection with a first intake port 74 for the hydraulic lash adjuster 70, and the second chamber 38 includes a second actuator port 76 in fluid connection with a second intake port 78 for the locking assembly 80. The hydraulic lash adjuster 70 and the locking assembly 80 are selectively operated based on the supply of hydraulic fluid from the supply assembly 12. Those skilled in the art will recognize that a plurality of rocker arm assemblies 60 would typically be present on the rocker arm shaft, and only a single rocker arm assembly 60 has been illustrated for the sake of clarity.

As shown in FIG. 2, the supply assembly 12 is in a switched off state for the locking assembly 80 of the rocker arm assembly 60 in which the solenoid 16 is in a first position and the control valve 18 of the supply assembly 12 directed to the switch feed channel 26 is closed. In the non-actuated state, the seepage orifice 50 allows seepage of hydraulic fluid from the first chamber 32 to the second chamber 38, as shown by the arrow in the seepage orifice 50 in FIG. 2. Due to the presence of the seepage orifice 50, the hydraulic fluid pressure of the second chamber 38 is less than the hydraulic fluid pressure of the first chamber 32, to the extent that the hydraulic fluid pressure of the second chamber 38 is below a pressure required to actuate the locking assembly 80 of the switchable rocker arm assembly 60. Hydraulic fluid in the first chamber 32 can therefore be fed to the second chamber 38 in the non-actuated state, and the second chamber 38 directs hydraulic fluid backwards through the switch channel 26 in the second journal 24 where it can exit to a tank connection. This residual hydraulic fluid through the second chamber 38 purges it of air pockets and air bubbles, and helps keep the second chamber 38 primed with hydraulic fluid for optimal switching times of the switchable valve train assembly 10.

As shown in FIG. 3, the supply assembly 12 is in an actuated state in which the solenoid 16 is in the second, switching state and the control valve 18 of the supply assembly 12 is connected to switching channel 26. In the actuated switching state, unthrottled pressurized hydraulic fluid is provided to the locking assembly 80 via the second chamber 38, to unlock (deactivate) a particular rocker arm. In one embodiment, the first mode of FIG. 2 corresponds to a locked mode in which the rocker arm assembly 60 is locked so that the associated valves of the switchable valve train assembly 10 are opened and closed for active cylinders. Furthermore, the second mode of FIG. 3 corresponds to an unlocked mode in which the rocker arm assembly is unlocked and therefore the valves of the switchable valve train assembly 10 remain closed, which is used in connection with deactivating certain cylinders. One of ordinary skill in the art would recognize from the present disclosure that the first mode of FIG. 2 could correspond to an unlocked mode, and the second mode of FIG. 3 could correspond to a locked mode; this arrangement could be used in connection with a cam profile switching strategy.

Having thus described the present invention in detail, it is to be appreciated and will be apparent to those skilled in the art that many physical changes, only a few of which are exemplified in the detailed description of the invention, could be made without altering the inventive concepts and principles embodied therein. It is also to be appreciated that numerous embodiments incorporating only part of the preferred embodiment are possible which do not alter, with respect to those parts, the inventive concepts and principles embodied therein. The present embodiment and optional configurations are therefore to be considered in all respects as exemplary and/or illustrative and not restrictive, the scope of the invention being indicated by the appended claims rather than by the foregoing description, and all alternate embodiments and changes to this embodiment which come within the meaning and range of equivalency of said claims are therefore to be embraced therein.

What is claimed is:

1. A switchable valve train assembly comprising:

a supply assembly including a fluid source for pressurized hydraulic fluid, and a solenoid and a control valve for selectively supplying the hydraulic fluid;

a first journal including a hydraulic lash adjuster feed channel in fluid connection with the fluid source;

a second journal including a switch channel in fluid connection with the fluid source;

a rocker shaft including a first chamber extending between a first axial end and a second axial end of the rocker shaft and a second chamber extending between the first axial end and the second axial end of the rocker shaft, a first end cap fixed on the first axial end of the rocker shaft and a second end cap fixed on the second axial end of the rocker shaft, the first end cap and the second end cap each defining axial ends of the first chamber and the second chamber, and a seepage orifice defined between the first chamber and the second chamber provides a fluid connection between the first chamber and the second chamber;

a feed port in the rocker shaft connects the hydraulic lash adjuster feed channel of the first journal to the first chamber;

a switch port in the rocker shaft connects the switch channel of the second journal to the second chamber; and a rocker arm assembly arranged on the rocker shaft includes a hydraulic lash adjuster and a locking assembly, the first chamber includes a first actuator port in fluid connection with a first intake port for the hydraulic lash adjuster, and the second chamber includes a second actuator port in fluid connection with a second intake port for the locking assembly.

2. The switchable valve train assembly of claim 1, further comprising a first sleeve that extends between the hydraulic lash adjuster feed channel of the first journal and the first chamber.

3. The switchable valve train assembly of claim 1, further comprising a second sleeve that extends between the switch channel of the second journal and the second chamber.

4. The switchable valve train assembly of claim 1, the supply assembly having a first state in which the control valve of the supply assembly to the switch channel is closed, the seepage orifice allows seepage of hydraulic fluid from the first chamber to the second chamber, and the second chamber directs hydraulic fluid to the switch channel in the second journal.

5. The switchable valve train assembly of claim 1, the supply assembly having a second state in which the solenoid is activated and the control valve of the supply assembly to the switch channel is open such that pressurized hydraulic fluid is provided via the switch channel to the locking assembly via the second chamber.

6. The switchable valve train assembly of claim 1, the rocker shaft includes a first axially extending flange at the first axial end and a second axially extending flange at the second axial end.

7. The switchable valve train assembly of claim 6, further comprising a first bolt radially extending through the first axially extending flange and a second bolt radially extending through the second axially extending flange.

8. The switchable valve train assembly of claim 6, wherein the first end cap is fixed to the first axial end of the rocker shaft via a press-fit against a radially inner surface of the first axially extending flange.

9. The switchable valve train assembly of claim 6, wherein the second end cap is fixed to the second axial end of the rocker shaft via a press-fit against a radially inner surface of the second axially extending flange.

10. The switchable valve train assembly of claim 1, wherein the seepage orifice has an internal diameter between 0.1 mm to 1.0 mm, and the seepage orifice has a length that is five to ten times larger than the internal diameter.

11. The switchable valve train assembly of claim 10, wherein the seepage orifice provides a hydraulic fluid pressure during operation between 0.1 bar to 0.4 bar.

12. A rocker shaft for a switchable valve train, the rocker shaft comprising:

a first chamber extending between a first axial end and a second axial end of the rocker shaft;

a second chamber extending between the first axial end and the second axial end of the rocker shaft;

a first end cap fixed on the first axial end of the rocker shaft;

a second end cap fixed on the second axial end of the rocker shaft, the first end cap and the second end cap each defining axial ends of the first chamber and the second chamber; and a seepage orifice defined between the first chamber and the second chamber that provides a fluid connection between the first chamber and the second chamber.

13. The rocker shaft of claim 12, wherein the seepage orifice has an internal diameter between 0.1 mm to 1.0 mm, and the seepage orifice has a length that is five to ten times larger than the internal diameter.

14. The rocker shaft of claim 12, further comprising a first axially extending flange at the first axial end and a second axially extending flange at the second axial end.

15. The rocker shaft of claim 14, further comprising a first bolt radially extending through the first axially extending flange and a second bolt radially extending through the second axially extending flange.

16. The rocker shaft of claim 14, wherein the first end cap is fixed to the first axial end of the rocker shaft via a press-fit against a radially inner surface of the first axially extending flange.

17. The rocker shaft of claim 14, wherein the second end cap is fixed to the second axial end of the rocker shaft via a press-fit against a radially inner surface of the second axially extending flange.

* * * * *